US010900407B2

(12) United States Patent
Otero Solivan et al.

(10) Patent No.: US 10,900,407 B2
(45) Date of Patent: Jan. 26, 2021

(54) MUFFLER WITH INTERNAL GAP HEAT SHIELD

(71) Applicant: Honda Motor Co., Ltd., Tokyo (JP)

(72) Inventors: Orlando Otero Solivan, Dublin, OH (US); Junichi Nakano, Hilliard, OH (US)

(73) Assignee: Honda Motor Co., Ltd., Tokyo (JP)

( * ) Notice: Subject to any disclaimer, the term of this patent is extended or adjusted under 35 U.S.C. 154(b) by 129 days.

(21) Appl. No.: 16/250,939

(22) Filed: Jan. 17, 2019

(65) Prior Publication Data

US 2020/0232375 A1 Jul. 23, 2020

(51) Int. Cl.

| | |
|---|---|
| ***F01N 1/00*** | (2006.01) |
| ***F01N 13/14*** | (2010.01) |
| ***F01N 13/18*** | (2010.01) |
| ***F01N 1/08*** | (2006.01) |

(52) U.S. Cl.

CPC ..... *F01N 13/14* (2013.01); *F01N 1/089* (2013.01); *F01N 13/1805* (2013.01)

(58) Field of Classification Search

CPC ..... F01N 13/14; F01N 1/089; F01N 13/1805
USPC ..... 60/323
See application file for complete search history.

(56) References Cited

U.S. PATENT DOCUMENTS

| | | | | |
|---|---|---|---|---|
| 4,598,790 | A | 7/1986 | Uesugi et al. | |
| 5,281,778 | A | 1/1994 | Cheladyn et al. | |
| 5,321,214 | A | 6/1994 | Uegane et al. | |
| 5,966,933 | A * | 10/1999 | Ishihara | F01N 13/08 180/309 |
| 6,789,644 | B2 * | 9/2004 | Mukaida | F01N 1/089 181/212 |
| 7,273,129 | B2 | 9/2007 | Harwood | |
| 7,401,463 | B2 * | 7/2008 | Tsuruta | F01N 13/14 138/110 |
| 7,942,237 | B2 * | 5/2011 | van de Flier | F01N 13/1888 181/256 |
| 8,608,237 | B2 | 12/2013 | Hwang et al. | |
| 9,810,117 | B2 * | 11/2017 | Hiraoka | F01N 1/006 |
| 2006/0042856 | A1 * | 3/2006 | Kim | F01N 13/1822 180/296 |
| 2006/0053779 | A1 * | 3/2006 | Belisle | F16L 23/08 60/299 |
| 2009/0001242 | A1 * | 1/2009 | Endo | B60K 13/04 248/610 |
| 2009/0159147 | A1 * | 6/2009 | Yamaguchi | F01N 13/1805 138/155 |
| 2010/0071990 | A1 * | 3/2010 | Amir | F01N 13/08 181/228 |
| 2013/0038090 | A1 * | 2/2013 | Hwang | B60R 13/0876 296/193.07 |
| 2015/0300234 | A1 * | 10/2015 | Hirukawa | B60K 13/04 180/309 |

(Continued)

*Primary Examiner* — Jason D Shanske
(74) *Attorney, Agent, or Firm* — American Honda Motor Co., Inc.; Joshua J. Freier

(57) ABSTRACT

A vehicle having a frame and an internal combustion engine. An exhaust system extends from the internal combustion engine. The exhaust system includes an exhaust muffler with an exhaust hanger. The exhaust hanger is secured to the frame with an elastic member. An internal heat shield is located on an inner surface of the exhaust muffler to form an interior space between the internal heat shield and the exhaust muffler. The internal heat shield reduces the heat transferred to the elastic member.

19 Claims, 8 Drawing Sheets

(56) References Cited

U.S. PATENT DOCUMENTS

| | | | | |
|---|---|---|---|---|
| 2016/0200187 | A1* | 7/2016 | Kim | B60K 13/04<br>180/309 |
| 2016/0290208 | A1* | 10/2016 | Darrell | F16L 55/02 |
| 2019/0055875 | A1* | 2/2019 | Fang | F01N 13/007 |
| 2019/0186331 | A1* | 6/2019 | Yamazaki | B60K 13/04 |

* cited by examiner

MUFFLER WITH INTERNAL GAP HEAT SHIELD

BACKGROUND

An exhaust system for a vehicle with an internal combustion engine experiences high temperatures from the hot exhaust gas flowing from the internal combustion engine of the vehicle. As a result, external surfaces of the exhaust system components, including the exhaust muffler, can quickly reach high surface temperatures. Exhaust system components typically include a metal hanger or pipe for supporting and securing to an exhaust mounting member of the vehicle. An elastic member is commonly used to support and secure the metal hanger on the exhaust system to the exhaust mounting member of the vehicle. The elastic member must be able to support and secure the exhaust system to the exhaust mounting member without being damaged or deformed from the high temperatures of the hot exhaust gas flowing from the internal combustion engine of the vehicle.

Additionally, it is advantageous to use an elastic member, such as a rubber compound, that is cost effective. Rubber compounds are susceptible to heat damage when used for support of exhaust systems if they are not shielded from the heat of the exhaust gas properly. Heat shields are well known in exhaust systems for protecting components of the vehicle from high temperatures. Applying a heat shield on an external surface of the exhaust system can reduce the amount of heat transferred to an external component, such as the metal hangar or pipe. However, with the heat shield on an external surface, it requires additional space, and may not be as aesthetically appealing. It would therefore be desirable to have a heat shield mounted on an interior surface of an exhaust component, such as an exhaust muffler, for protecting against the high temperatures of the exhaust gas heat from being transferred to the metal hanger and the elastic member.

BRIEF SUMMARY

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

In accordance with one aspect of the present disclosure, an exhaust system for a vehicle having a frame and an internal combustion engine includes an exhaust muffler. The exhaust muffler includes an exhaust hanger. The exhaust hanger is secured to the frame with an elastic member. An internal heat shield is located on an inner surface of the exhaust muffler to form an interior space between the internal heat shield and the exhaust muffler. The internal heat shield reduces the heat transferred to the elastic member.

In accordance with another aspect of the present disclosure, an exhaust system for a vehicle having a frame and an internal combustion engine includes an exhaust pipe guiding exhaust gas rearward from the internal combustion engine to an exhaust muffler. A cargo area is rearward of a vehicle seat and attached to the frame. The internal combustion engine is at least partially encompassing an area under the cargo area. An exhaust mounting member is secured to the frame and an exhaust hanger is located on an end cap of the exhaust muffler. An elastic member secures the exhaust hanger to the exhaust mounting member. The exhaust muffler includes an internal heat shield on an inner surface of the end cap for insulating the elastic member from the heat of the exhaust gas.

In accordance with yet another aspect of the present disclosure, an exhaust system for a vehicle having a frame and an internal combustion engine includes an exhaust muffler with an end cap. An internal heat shield with a wall forming a peripheral flange is attached to an inner surface of the end cap. The internal heat shield includes a depressed portion that is interior of the peripheral flange to define to an interior space between the internal heat shield and the end cap.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Embodiments are hereinafter described in detail in connection with the views and examples of FIGS. 1-8, wherein like numbers indicate the same or corresponding elements throughout the views. It should, of course, be understood that the description and drawings herein are merely illustrative and that various modifications and changes can be made in the structures disclosed without departing from the concepts of the present disclosure.

Figure 1:
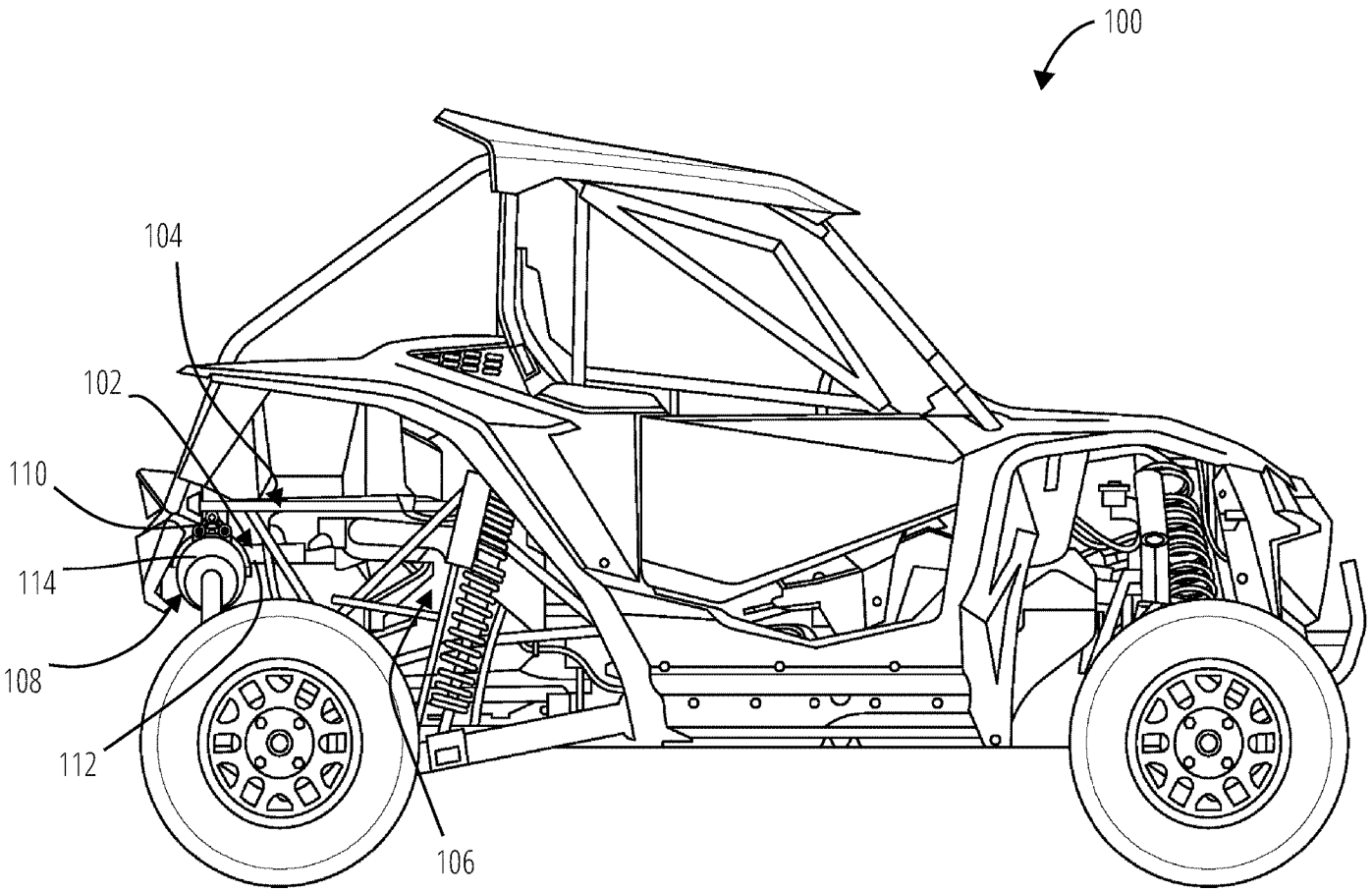
FIG. 1 is a right-side view of the vehicle.

FIG. 1 is a right-side view of a vehicle 100, particularly of the type known as an all-terrain vehicle ("ATV") or a side-by-side vehicle ("S×S"). In the vehicle 100 illustrated in FIG. 1, an exhaust system 102 with an exhaust muffler 108 is secured to the frame 104 with an elastic member 110. The exhaust system 102 includes an exhaust pipe 112 extending from the internal combustion engine 106 to the exhaust muffler 108. The exhaust pipe 112 extends rearward from an internal combustion engine 106 guiding exhaust gas to the exhaust muffler 108. As shown in FIG. 1, the exhaust muffler 108 may include an end cap 114. The end cap 114 may be attached to the exhaust muffler 108 by welding or other methods which allow it to be secured to the exhaust muffler 108 that can withstand heat.

Figure 2:
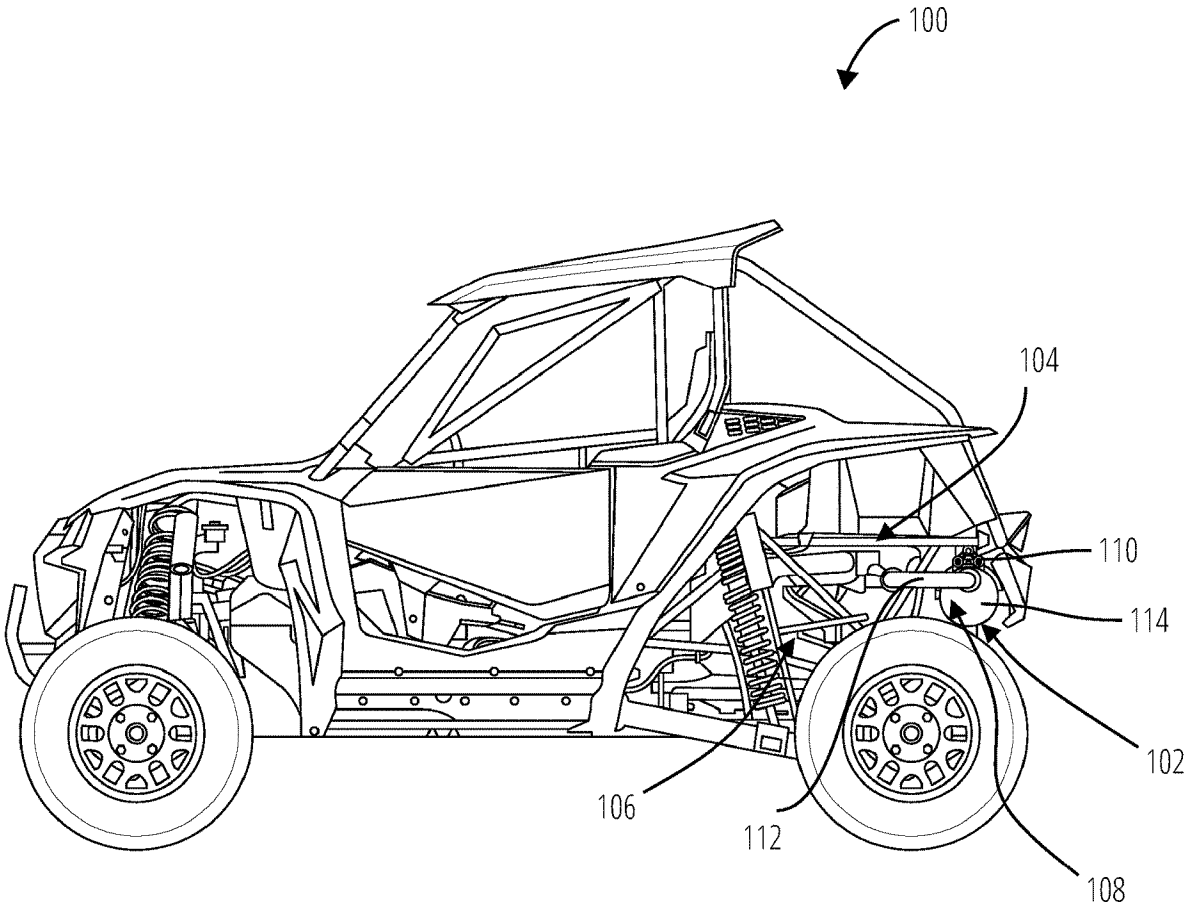
FIG. 2 is a left-side view of the vehicle.

FIG. 2 is a left-side view of a vehicle 100. FIG. 2 shows the left side view of the exhaust system 102 with the exhaust pipe 112 extending from the internal combustion engine 106 to the exhaust muffler 108. Similar to FIG. 1, an additional elastic member 110 secures the exhaust system 102 to the frame 104 of the vehicle 100. An elastic member 110 is shown supporting the exhaust system 102 from opposite ends of the exhaust muffler 108 in FIG. 1 and FIG. 2; however, more elastic members may be needed and the placement may vary depending on the vehicle 100 and weight of the exhaust system 102.

Figure 3:
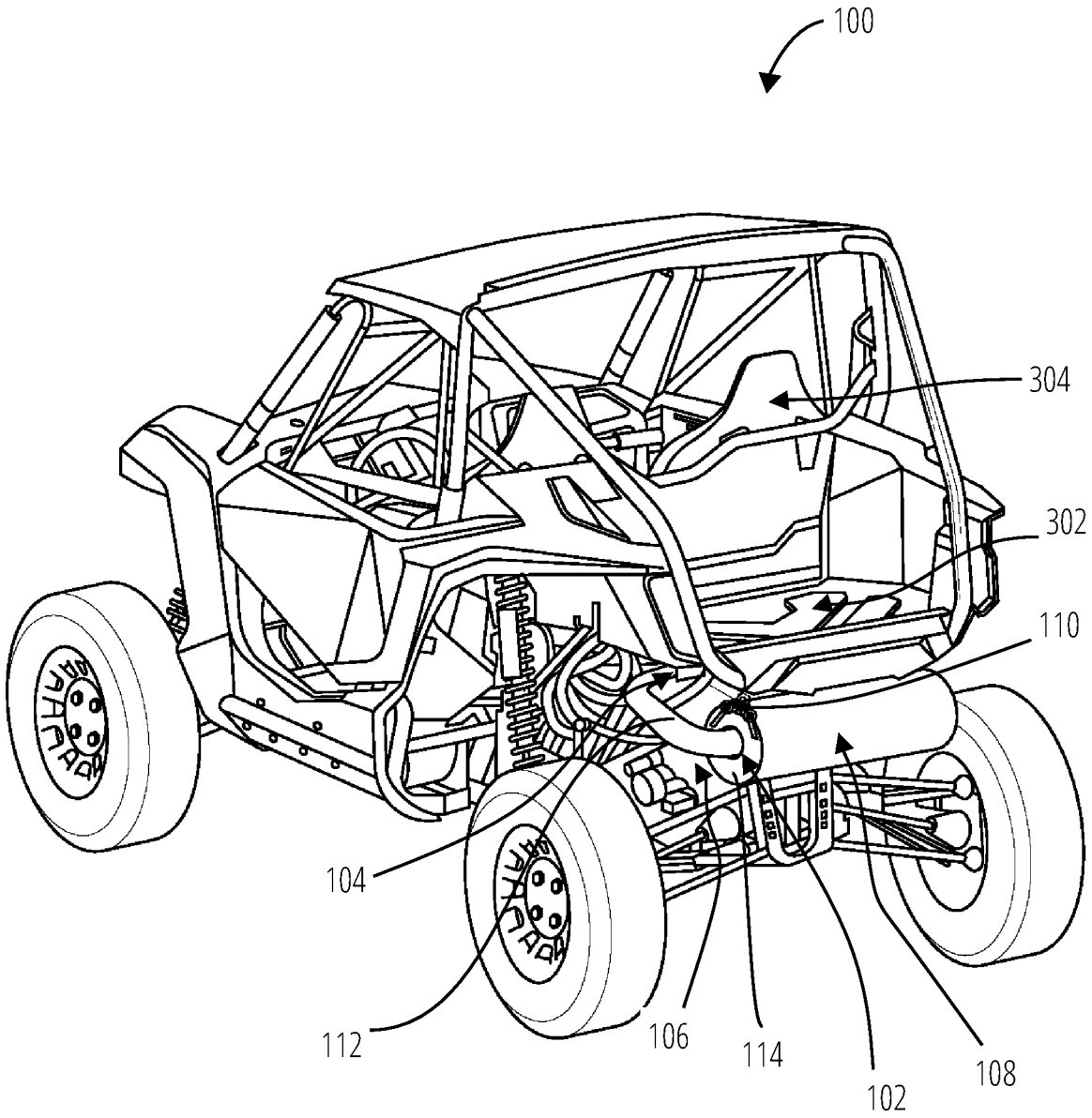
FIG. 3 is a perspective view of the vehicle.
Figure 5:
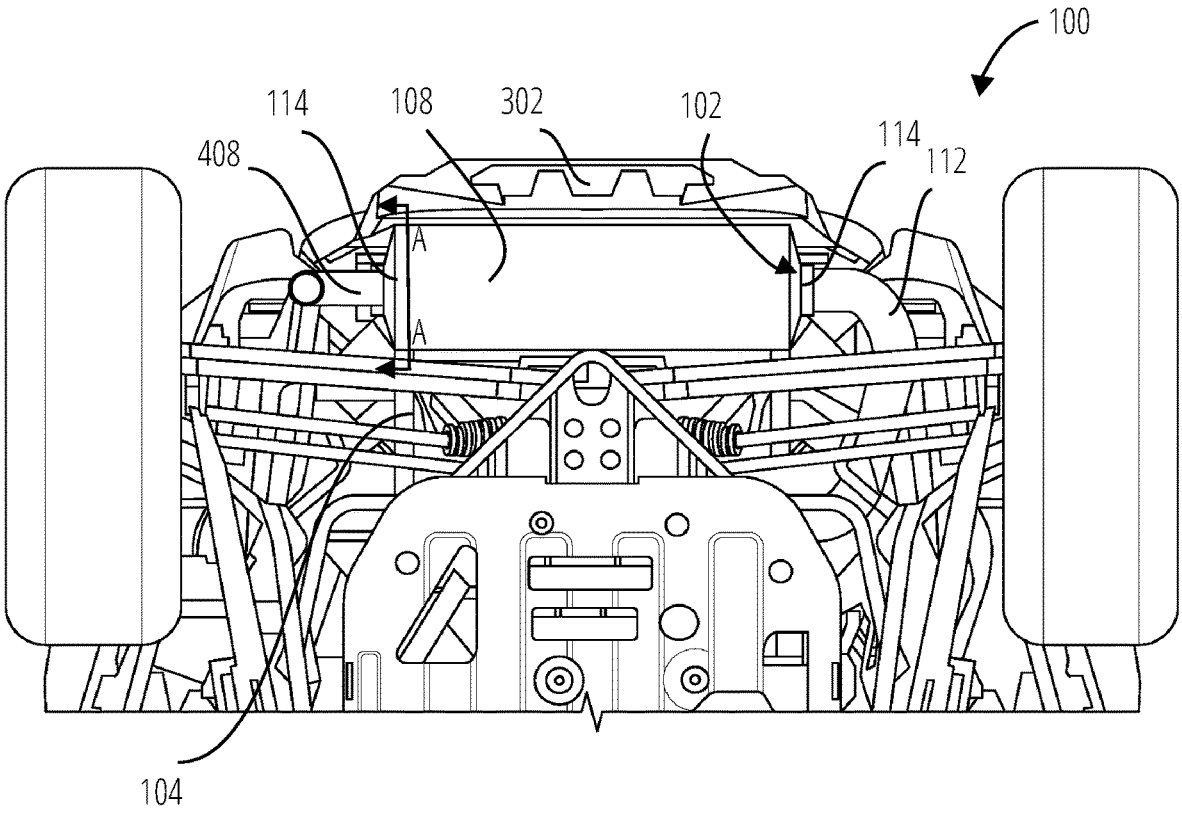
FIG. 5 is an underneath view of the rear portion of the vehicle and the exhaust system.

One embodiment of the vehicle 100 is illustrated in FIG. 3. FIG. 3 is a perspective view of the vehicle 100. In vehicle 100 illustrated in FIG. 3, a cargo area 302 is located rearward of a vehicle seat 304 of the vehicle 100. The cargo area 302 is attached to the frame 104. At least a portion of the internal combustion engine 106 is partially encompassing an area under the cargo area 302. The exhaust pipe 112 is generally u-shaped, as shown in FIG. 3 and FIG. 5.

Figure 4:
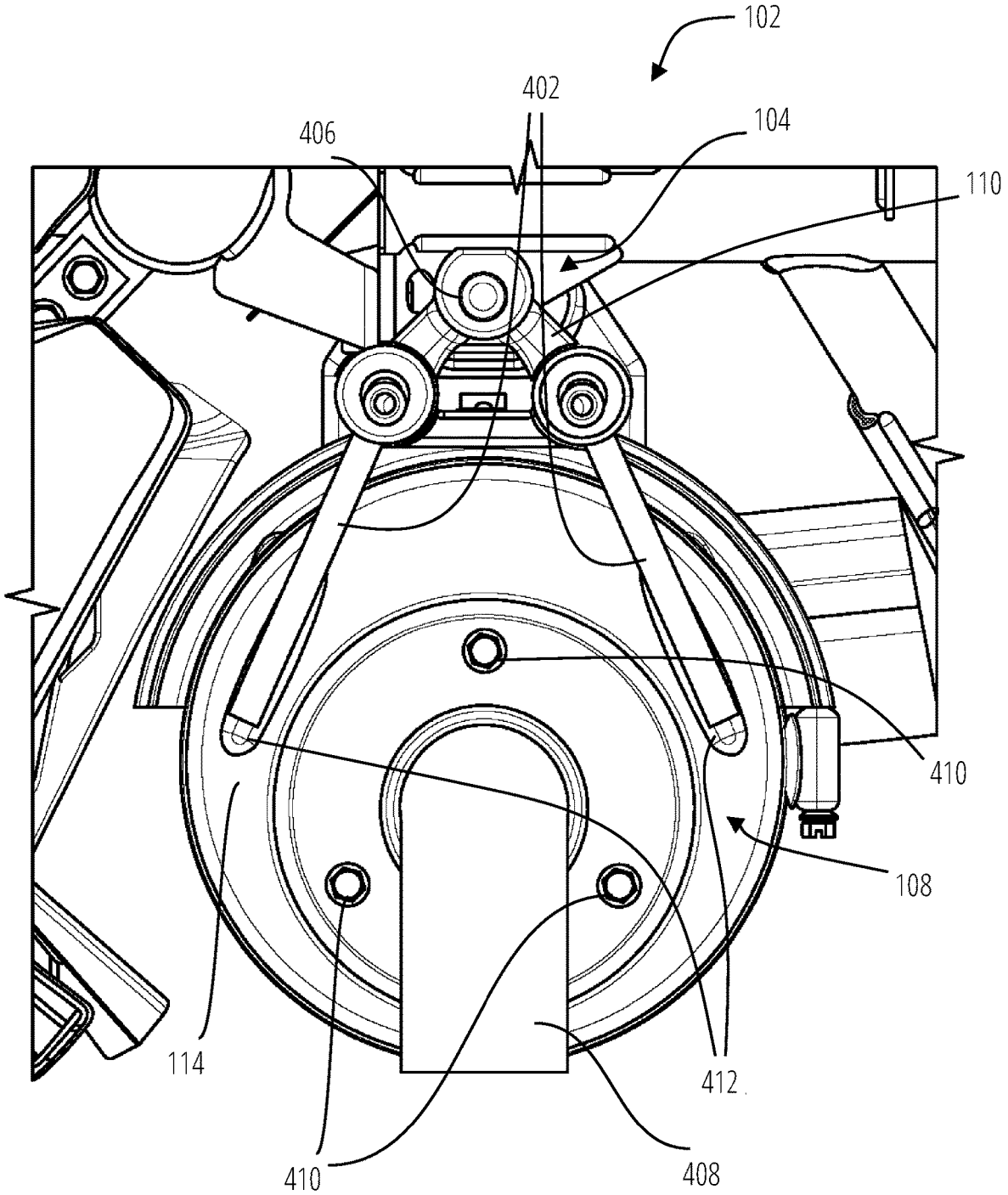
FIG. 4 is a close-up right-side view of the exhaust muffler of the exhaust system attached to the vehicle.

FIG. 4 is a close-up right-side view of the exhaust muffler 108 of the exhaust system 102 attached to the vehicle 100. The exhaust muffler 108 may include an exhaust hanger 402 secured to a concave surface 412 on an outside surface the end cap 114. The exhaust hanger 402 is envisioned to be a cylindrical steel pipe. Exhaust hangers are typically welded to the exhaust system 102. The concave surface 412 on the outside surface of the end cap 114 may assist with placing and welding a cylindrical exhaust hanger 402 to the end cap 114 of the exhaust muffler 108.

Figure 6:
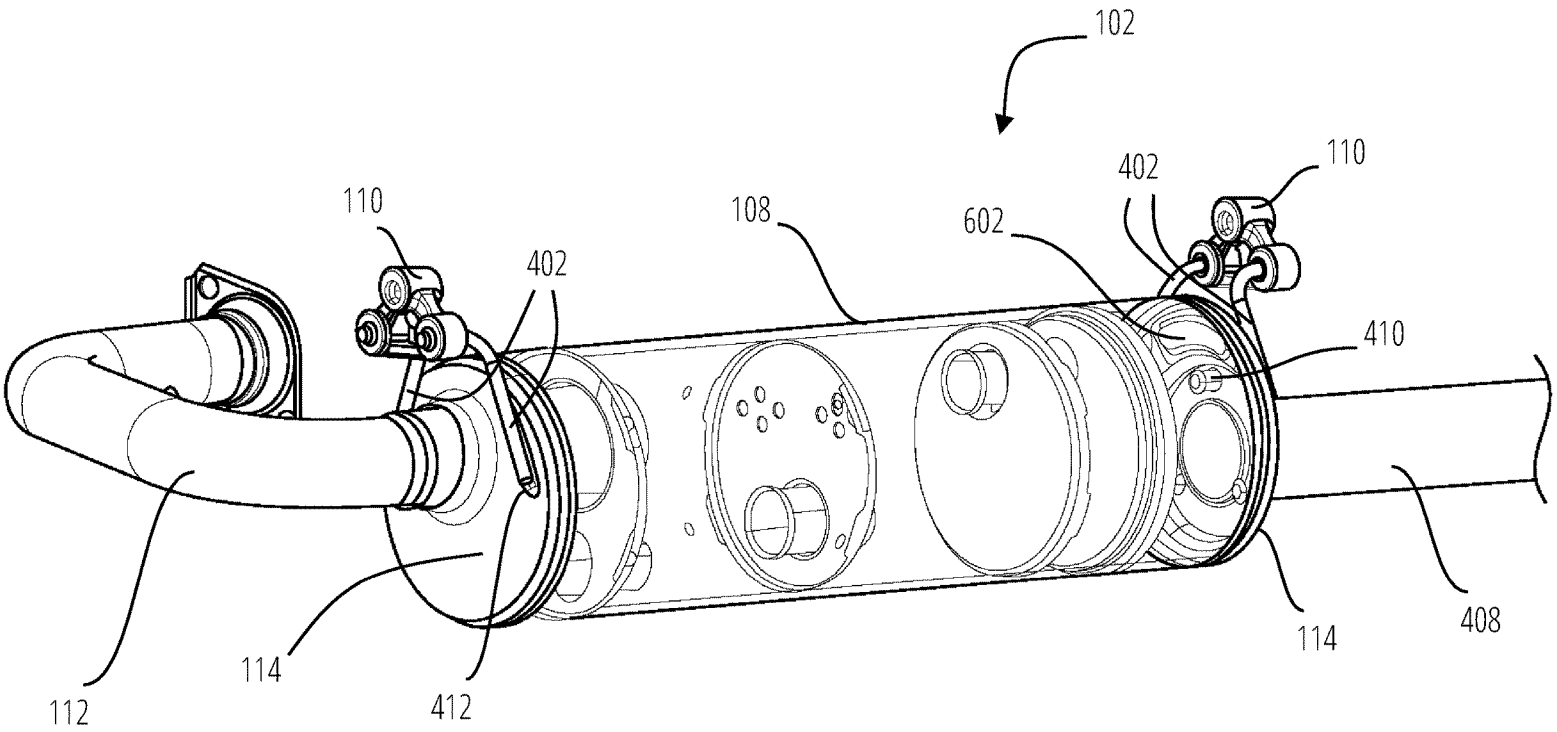
FIG. 6 is a cutaway perspective view of the exhaust system.
Figure 8:
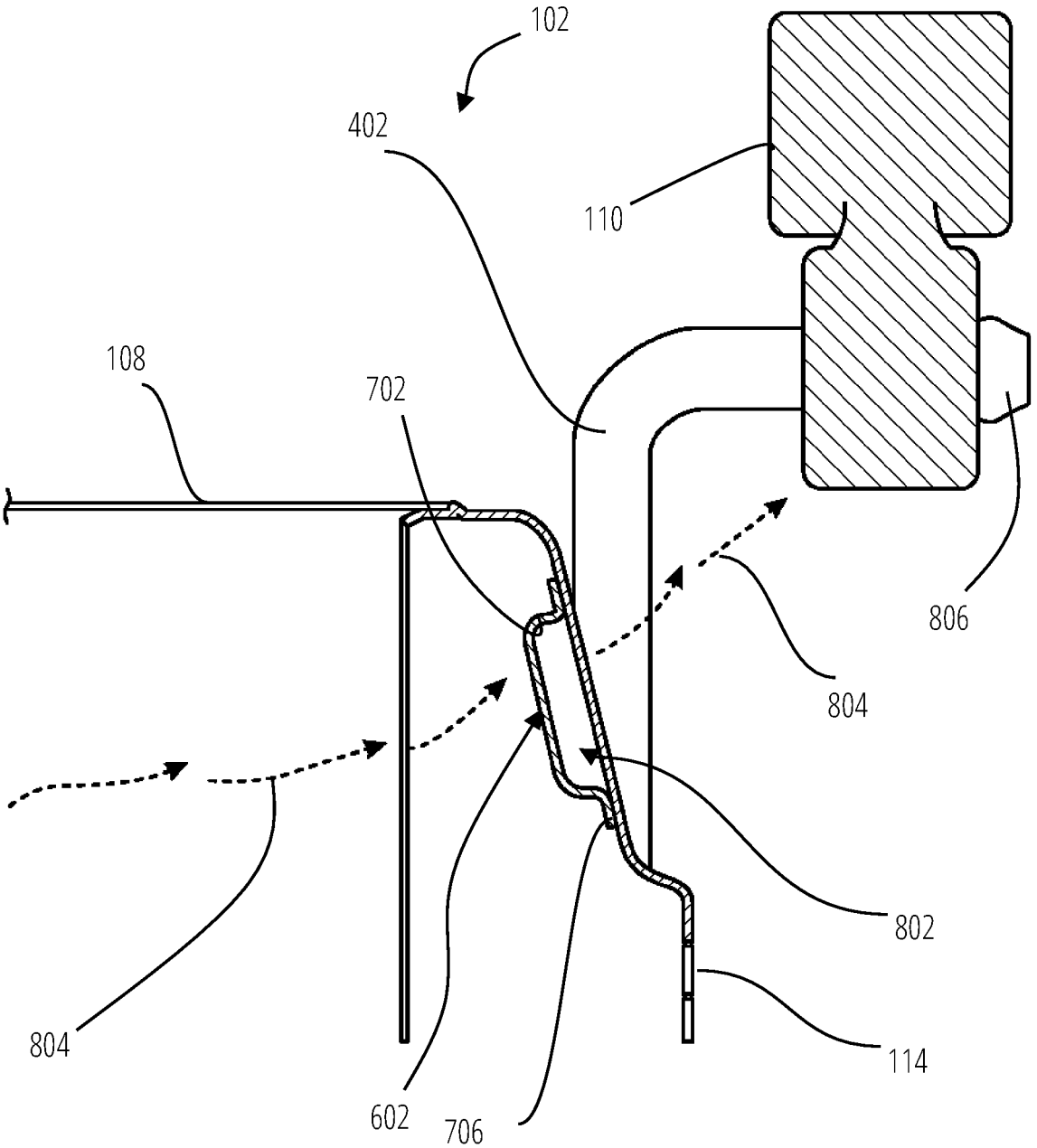
FIG. 8 is a cutaway rear view of the end cap of the exhaust muffler.

The exhaust hanger 402 may include two members as shown in FIG. 4. An exhaust hanger 402 with one member may be used depending upon the weight of the weight of the exhaust system 102 and the security and support required for the driving conditions of the vehicle 100. The elastic member 110 is securing the exhaust hanger 402 to an exhaust mounting member 406. Additionally, the exhaust hanger 402 may be L-shaped or curved, as shown in FIG. 6 and FIG. 8 to assist with placement in the elastic member.

The exhaust mounting member 406 is secured to the frame 104. The exhaust mounting member 406 is envisioned to be welded to the frame 104; however, it will be appreciated that other methods may be used; such as fasteners. The exhaust hanger 402 and the exhaust mounting member 406 may include an enlarged portion 806 on the end inserted through the elastic member 110 for retention. The enlarged portion 806 of the exhaust hanger 402 can be seen in FIG. 8.

Figure 7:
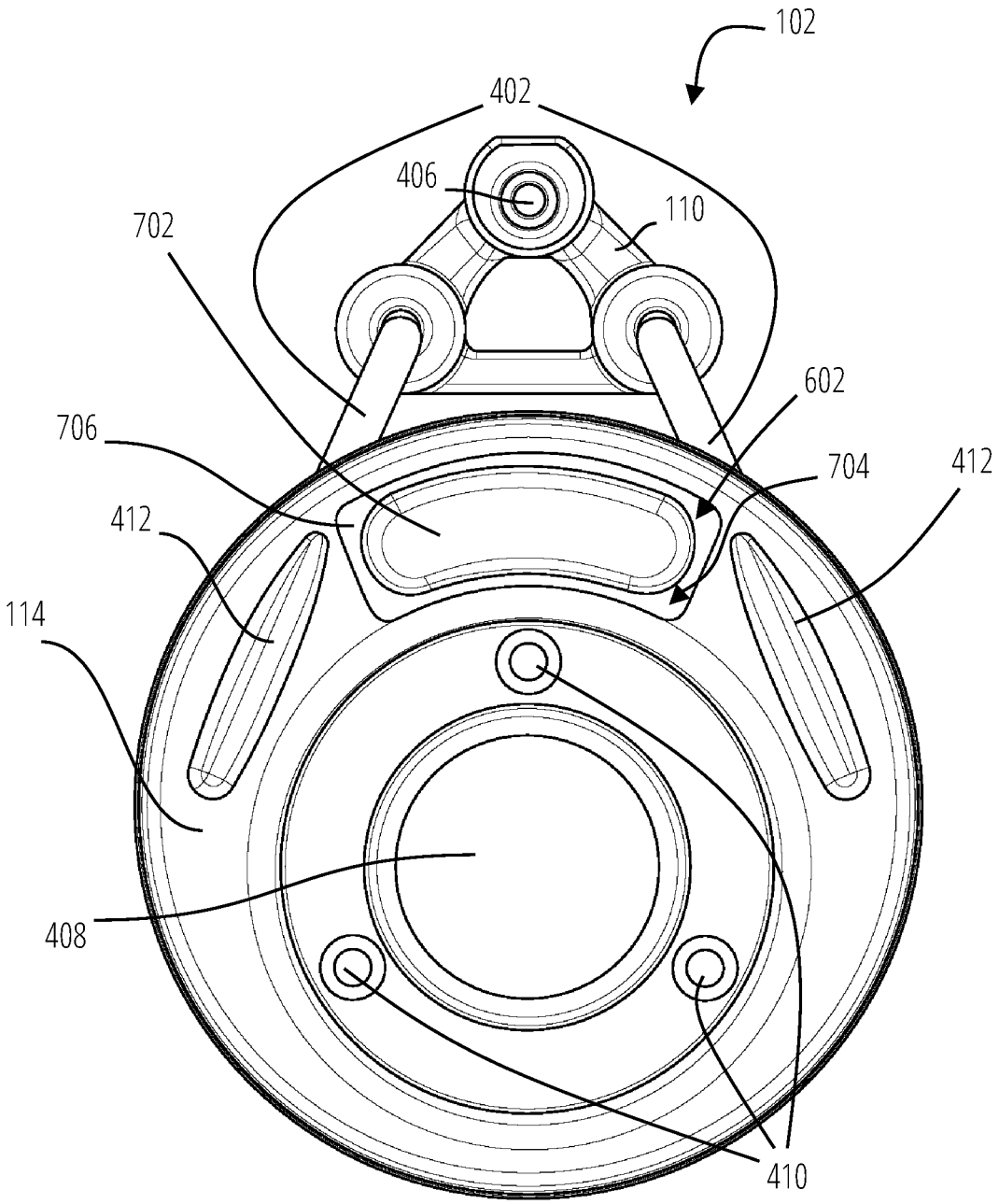
FIG. 7 is a cutaway side view of the exhaust system of FIG. 5 along section line AA.

As shown in FIG. 4, the exhaust system 102 may include a tailpipe 408 secured to the end cap 114 of the exhaust muffler 108. The tailpipe 408 is shown to be attached to the end cap 114 with fasteners 410. It will be appreciated that other attachments means, such as welding, may be utilized. The tailpipe 408 attached to the end cap 114 of the exhaust muffler 108 is also shown in FIG. 6 and FIG. 7. The fasteners 410 may include a typical bolt and nut or a press-fit bolt inserted into the end cap 114 and secured with a nut.

FIG. 5 is an underneath view of the rear portion of the vehicle 100 and the exhaust system 102. The exhaust muffler 108 is at least partially encompassing an area under the cargo area. The exhaust pipe 112 is u-shaped to route exhaust gas from the internal combustion engine 106 to the exhaust muffler 108 that extends in the width direction at the rear of the vehicle 100. The exhaust muffler 108 may be mounted in the width direction of the vehicle 100 due to space constraints. For example in vehicle 100, the exhaust muffler 108 is mounted in the width direction instead of the length direction to avoid the exhaust muffler 108 from protruding out from the cargo area 302 of the vehicle 100. FIG. 5 also depicts a portion of the frame 104 for attaching the cargo area 302.

FIG. 6 is a cutaway perspective view of the exhaust system 102. Exhaust gas travels through the exhaust pipe 112 and into the exhaust muffler 108. The exhaust gas travels through the exhaust muffler 108 to reduce noise. As the exhaust gas travels through the exhaust muffler 108 to the end cap 114 with the attached tailpipe 408. The heat from the exhaust gas is transferred to the end cap 114. The exhaust hanger 402 is attached to the end cap 114 and as a result, the heat from the exhaust gas is transferred from the end cap 114 to the exhaust hanger 402. Also, the elastic member 110 is attached to the exhaust hanger 402, so the heat from the exhaust gas is also transferred to the elastic member 110 through the exhaust hanger 402. In addition, the exhaust hanger 402 and the elastic member 100 experience radiant heat from the exhaust muffler 108 due to their close proximity.

The elastic member 110 needs to support and secure the exhaust system 102 without being damaged or deformed from the high temperatures of the hot exhaust gas traveling from the internal combustion engine 106 of the vehicle 100. The elastic member 110 is generally a flexible member, such as rubber or ethylene propylene diene monomer (EPDM) synthetic rubber. An internal heat shield 602 is placed on inside surface of the end cap 114. The internal heat shield 602 reduces the heat transferred to the end cap 114, exhaust hanger 402, and elastic member 110.

FIG. 7 is a cutaway side view of the exhaust system 102 of FIG. 5 along section line AA. The internal heat shield 602 includes a depressed portion 702. The depressed portion 702 extends inwardly in the exhaust muffler 108, as shown in FIG. 8. Additionally, the internal heat shield 602 includes a wall 704 forming a peripheral flange 706. The depressed portion 702 is interior of the peripheral flange 706 of the wall 704. The internal heat shield 602 may be inside a widest portion of the two members of the exhaust hanger 402 as shown in FIG. 7. The size and location of the internal heat shield 602 may vary depending amount the amount heat reduction required and space inside the exhaust muffler 108.

The internal heat shield 602 may be welded to the end cap 114 of the exhaust muffler 108. For example, the peripheral flange 706 of the wall 704 may be spot welded at its four corners. The peripheral flange 706 may include extra material at its four corners to accommodate spot welding, as shown in FIG. 7.

Additionally, the concave surface 412 is shown in FIG. 7 extending inwardly into the exhaust muffler 108. The tailpipe 408 is shown secured to the end cap 114 with fasteners 410 in FIG. 7. The elastic member 110 is generally triangular in shape and may include an opening between the two holes for the exhaust hanger 402 and the hole for the exhaust mounting member 406.

One embodiment of a portion of the vehicle 100 is illustrated in FIG. 8. FIG. 8 is a cutaway rear view of the end cap 114 of the exhaust muffler 108. The depressed portion 702 of the internal heat shield 602 is shown extending inwardly. The depressed portion 702 is envisioned to be formed or stamped into the internal heat shield 602. The internal heat shield 602 could be made of a variety of metal material; however, a common material such as steel would be cost effective and allow welding to a steel exhaust muffler 108. The depressed portion 702 creates an interior space 802 between the internal heat shield 602 and the end cap 114. The interior space 802 allows the heat from exhaust gas 804 to circulate and dissipate before contacting the end cap 114. The circulation and dissipation of the heat from the exhaust gas 804 lowers the temperature of the end cap 114 that and the exhaust hanger 402. As a result, the heat from the exhaust gas 804 is lowered before being transferred to the elastic member 110. Additionally, the heat radiating from the end cap 114 is reduced.

The depressed portion 702 may be filled with only air, but depending on the amount of heat reduction necessary an insulating material may be used to fill the depressed portion 702. Fibrous steel material, a thin steel foil, or ceramic paper may be used as the insulating material to fill the depressed portion 702. The insulating material will absorb and reduce some of the heat or act as a radiant heat barrier to the exhaust gas 804 to reduce the temperature of the exhaust gas 804 before being transferred to the exhaust hanger 402 and the elastic member 110. As a result, the temperature of the elastic member 110 is lowered during vehicle operation and the rubber or EPDM synthetic rubber can support and secure the exhaust system 102 to the vehicle 100 without being deformed or damaged from the heat of the exhaust gas 804. Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments as defined in the appended claims.

The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. An exhaust system for a vehicle having a frame and an internal combustion engine comprising:

an exhaust muffler with an exhaust hanger secured to the frame with an elastic member;

the exhaust hanger includes two members;

an internal heat shield with a peripheral flange and a depressed portion interior the peripheral flange; and the depressed portion of the internal heat shield on an inner surface of the exhaust muffler is positioned between the two members of the exhaust hanger forming an interior space between the internal heat shield and an end cap of the exhaust muffler to reduce the heat transferred to the elastic member.

2. The exhaust system of claim 1, wherein the exhaust muffler extends in a width direction at a rear portion of the vehicle.

3. The exhaust system of claim 1, wherein a u-shaped exhaust pipe guides exhaust gas rearward from the internal combustion engine to the exhaust muffler.

4. The exhaust system of claim 3, wherein the interior space is filled with an insulating material to reduce heat from the exhaust gas.

5. The exhaust system of claim 1, wherein the two members of the exhaust hanger are welded to a concave surface on the end cap of the exhaust muffler.

6. The exhaust system of claim 5, wherein the internal heat shield is positioned between an opening in the end cap for a tailpipe and an outer circumference of the end cap.

7. The exhaust system of claim 1, wherein the internal heat shield is spot welded to an inner surface of the end cap of the exhaust muffler.

8. The exhaust system of claim 6, wherein the end cap includes fasteners for securing the tailpipe.

9. An exhaust system for a vehicle having a frame and an internal combustion engine comprising:

an exhaust pipe guiding exhaust gas rearward from the internal combustion engine to an exhaust muffler;

a cargo area rearward of a vehicle seat and attached to the frame;

the internal combustion engine at least partially encompassing an area under the cargo area;

an exhaust mounting member secured to the frame;

an exhaust hanger including two members on an end cap of the exhaust muffler;

an elastic member securing the exhaust hanger to the exhaust mounting member; and the exhaust muffler includes an internal heat shield with a wall forming a peripheral flange positioned between an opening in the end cap for a tailpipe and an outer circumference of the end cap and located entirely on an inner surface of the end cap for insulating the elastic member from the heat of the exhaust gas.

10. The exhaust system of claim 9, wherein the internal heat shield includes a depressed portion to create an interior space between the internal heat shield and the end cap of the exhaust muffler.

11. The exhaust system of claim 10, wherein the interior space is filled with an insulating material to reduce heat from the exhaust gas.

12. The exhaust system of claim 9, wherein the the two members are welded to a concave surface on the end cap of the exhaust muffler.

13. The exhaust system of claim 10, wherein the depressed portion of the internal heat shield is positioned between the two members of the exhaust hanger.

14. An exhaust system for a vehicle having a frame and an internal combustion engine comprising:

an exhaust muffler having an end cap;

an internal heat shield comprising a wall forming a peripheral flange attached to an inner surface of the end cap; and a depressed portion interior of the peripheral flange positioned between two members of an exhaust hanger to define to an interior space between the internal heat shield and the end cap.

15. The exhaust system of claim 14, wherein the peripheral flange surrounds the entire depressed portion.

16. The exhaust system of claim 15, wherein the peripheral flange is spot welded to the inner surface of the end cap.

17. The exhaust system of claim 14, wherein the interior space is filled with an insulating material to reduce heat from exhaust gas.

18. The exhaust system of claim 14, wherein the two members are welded to a concave surface on the end cap of the exhaust muffler for securing the exhaust muffler to an elastic member.

19. The exhaust system of claim 18, wherein the internal heat shield is positioned between an opening in the end cap for a tailpipe and an outer circumference of the end cap.

* * * * *